US007269914B2

(12) United States Patent
Lee

(10) Patent No.: US 7,269,914 B2
(45) Date of Patent: Sep. 18, 2007

(54) STERILIZING APPARATUS FOR FOOTWEAR

(75) Inventor: Jae-seok Lee, Gyeonggi-do (KR)

(73) Assignee: Magicyura Inc., Gyeonggi-do (KR)

( * ) Notice: Subject to any disclaimer, the term of this patent is extended or adjusted under 35 U.S.C. 154(b) by 137 days.

(21) Appl. No.: 11/164,058

(22) Filed: Nov. 8, 2005

(65) Prior Publication Data

US 2006/0096115 A1 May 11, 2006

(30) Foreign Application Priority Data

Nov. 9, 2004 (KR) ..... 10-2004-0090815

(51) Int. Cl.
*F26B 25/00* (2006.01)
*F26B 3/00* (2006.01)

(52) U.S. Cl. ..... 34/104; 34/202; 219/506; 219/538

(58) Field of Classification Search ..... 34/104, 34/202; 219/211, 538, 506, 546, 549
See application file for complete search history.

(56) References Cited

U.S. PATENT DOCUMENTS 2,070,858 A * 2/1937 Des Jardins et al. ..... 219/546
4,981,651 A * 1/1991 Horng ..... 34/104
5,451,747 A * 9/1995 Sullivan et al. ..... 219/549

FOREIGN PATENT DOCUMENTS

KR 1020000072327 A 12/2000
KR 1020020006636 A 1/2002
KR 1020020073466 A 9/2002
KR 1020020084005 A 11/2002
KR 1020040088821 A 10/2004

* cited by examiner

*Primary Examiner*—Jiping Lu
(74) *Attorney, Agent, or Firm*—Jianq Chyun IP Office

(57) ABSTRACT

Disclosed is a sterilizing apparatus for footwear. The sterilizing apparatus includes a plane heater having a carbon fiber embedded heating paper, a pair of electrodes installed at one side of the carbon fiber embedded heating paper while being spaced from each other, and insulating members stacked on upper and lower portions of the carbon fiber embedded heating paper and edge portions of which are thermally bonded to each other; a housing made of a flexible material and formed at an inner peripheral portion thereof with an insertion groove, in which the housing has a power line receiving hole at a lower end of a bottom surface thereof, a cation generating material receiving hole, and a plurality of corrugated grooves; an AC/DC converter having a time display section and a timer setting section; and a cation generating material fixedly inserted into the cation generating material receiving hole by adhesive.

3 Claims, 3 Drawing Sheets

STERILIZING APPARATUS FOR FOOTWEAR

CROSS-REFERENCE TO RELATED APPLICATION

This application claims the priority benefit of Korean application serial no. 10-2004-0090815, filed on Nov. 09, 2004. All disclosure of the Korean application is incorporated herein by reference.

BACKGROUND OF THE INVENTION

1. Field of the Invention

The present invention relates to a sterilizing apparatus for footwear, capable of sterilizing or killing harmful bacteria living in the footwear while safely and easily drying various types of the footwear. More particularly, the present invention relates to a sterilizing apparatus for footwear, in which the sterilizing apparatus includes a plane heater having a carbon fiber embedded heating paper, a pair of electrodes installed at one side of the carbon fiber embedded heating paper while being spaced from each other so as to apply electricity to the carbon fiber embedded heating paper, and insulating members stacked on upper and lower portions of the carbon fiber embedded heating paper and edge portions of which are thermally bonded to each other; a housing made of a flexible material and formed at an inner peripheral portion thereof with an insertion groove for receiving the plane heater, in which the housing has a power line receiving hole at a lower end of a bottom surface thereof, a cation generating material receiving hole at an upper end of the bottom surface thereof, and a plurality of corrugated grooves at both lateral sides thereof; an AC/DC converter having a time display section and a timer setting section; and a cation generating material fixedly inserted into the cation generating material receiving hole by means of adhesive, wherein the footwear can be dried by means of heat generated from the plane heater, the sterilizing apparatus can be easily introduced into the whole area of the bottom of long footwear, such as boots, because the plane heater and the housing have the flexible characteristics, stability of the sterilizing apparatus can be improved because the sterilizing apparatus uses AC power with the timer, and harmful bacteria charged with anions may be killed or sterilized by means of the cation generating material.

2. Description of the Prior Art

In general, footwear is one of body protect articles for protecting a foot of a user and includes an inner sole part for protecting the sole of a foot of the user and a body part for protecting the instep and lateral sides of the foot of the user. Such footwear is fabricated in the form of sports shoes, rubber shoes, or ordinary shoes according to materials, usage and designs thereof and is used as a living necessary.

When a person wearing the footwear walks or runs, the footwear always makes contact with the ground, so the footwear may absorb sweat from the foot of the person wearing the footwear. In addition, since the footwear is always exposed to impurities, such as dust or rainwater, the impurities are easily attached to the footwear. In this case, the footwear may become moist. If the sweat or impurities absorbed in the footwear react with microorganisms, such as bacteria, the sweat or impurities may be rotten, thereby causing the propagation of bacteria. Thus, not only is a bad smell generated from the footwear, but also various diseases, such as an athlete's foot, are caused in the foot of the person.

Meanwhile, if the impurities are attached to the surface of the footwear or the bad smell is generated from the footwear, a person washes and dries the footwear. However, if the weather is humid or rainy, it takes a long time for drying the footwear, so the person cannot wear the footwear at a time required by the person or an inner portion of the footwear may be contaminated during the drying process for the footwear due to the propagation of bacteria.

In order to solve the above problem, footwear driers have been developed and extensively used. However, most conventional footwear driers may dry the footwear using a heating unit by accommodating the footwear in a closed space (drying chamber) of the footwear drier. Therefore, the bad smell generated from the footwear may remain in the drying chamber of the footwear drier, so that the bad smell may not be completely removed from the footwear. In addition, the bad smell remaining in the drying chamber of the footwear drier may permeate into another footwear when another footwear is dried in the footwear drier.

For this reason, another conventional footwear drier having an air intake unit and an air discharge unit has been proposed. However, the conventional footwear drier represents a low drying efficiency. In addition, since the conventional footwear drier must have a size sufficient for accommodating the footwear therein, the volume of the conventional footwear drier may be enlarged, so portability of the conventional footwear drier may be degraded.

In addition, in a case of the conventional footwear drier using a nichrome wire as a heating unit, a cover is necessary to protect the nichrome wire. However, such a cover has no flexibility, so the cover cannot be bent, so that the conventional footwear drier is not adaptable for boots, military shoes or mountain-climbing boots because it cannot be introduced into the whole area of the bottom of the boots, military shoes or mountain-climbing boots.

Meanwhile, still another conventional footwear drier equipped with an anion generating unit has been proposed in order to sterilize harmful bacteria existing in the footwear by using the anion generating unit. However, the conventional footwear drier represents the low sterilization efficiency for the harmful bacteria because the harmful bacteria live in the footwear.

SUMMARY OF THE INVENTION

Accordingly, the present invention has been made to solve the above-mentioned problems occurring in the prior art, and an object of the present invention is to provide a sterilizing apparatus for footwear, capable of sterilizing or killing harmful bacteria living in the footwear while safely and easily drying various types of the footwear.

In order to accomplish the above object, the present invention provides a sterilizing apparatus for footwear, in which the sterilizing apparatus includes a plane heater having a carbon fiber embedded heating paper, a pair of electrodes installed at one side of the carbon fiber embedded heating paper while being spaced from each other so as to apply electricity to the carbon fiber embedded heating paper, and insulating members stacked on upper and lower portions of the carbon fiber embedded heating paper and edge portions of which are thermally bonded to each other; a housing made of a flexible material and formed at an inner peripheral portion thereof with an insertion groove for receiving the plane heater, in which the housing has a power line receiving hole at a lower end of a bottom surface thereof, a cation generating material receiving hole at an upper end of the bottom surface thereof, and a plurality of corrugated grooves at both lateral sides thereof; an AC/DC converter having a time display section and a timer setting section; and a cation generating material fixedly inserted into the cation generating material receiving hole by means of adhesive, wherein the footwear can be dried by means of heat generated from the plane heater, the sterilizing apparatus can be easily introduced into the whole area of the bottom of long footwear, such as boots, because the plane heater and the housing have the flexible characteristics, stability of the sterilizing apparatus can be improved because the sterilizing apparatus uses AC power with the timer, and harmful bacteria charged with anions may be killed or sterilized by means of the cation generating material.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to accompanying drawings.

Figure 1:
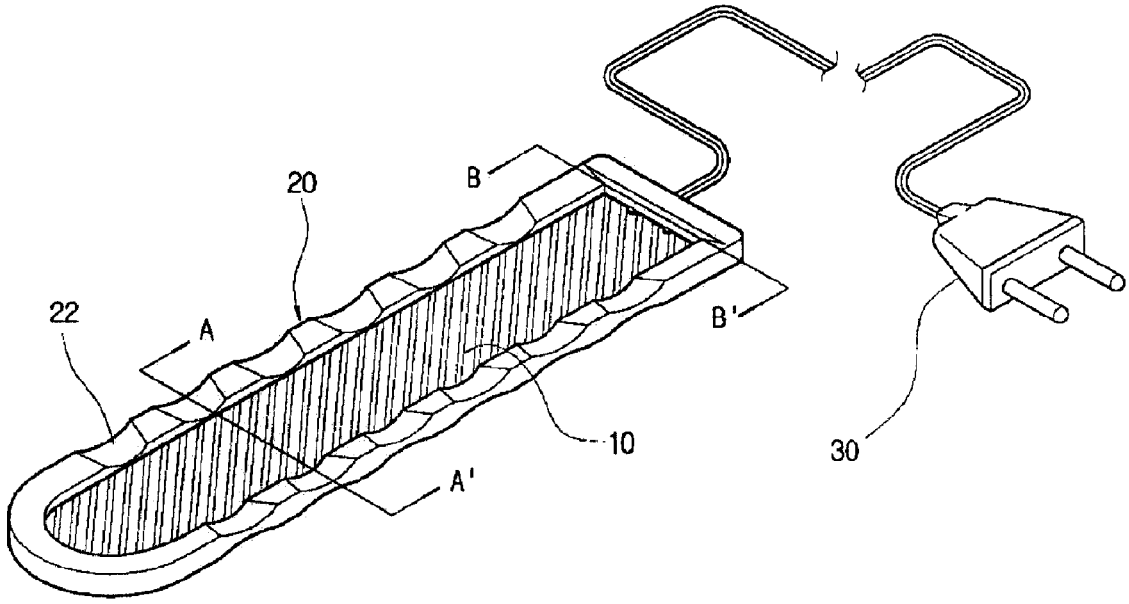
FIG. 1 a partially sectional perspective view illustrating a sterilizing apparatus according to one embodiment of the present invention.
Figure 2:
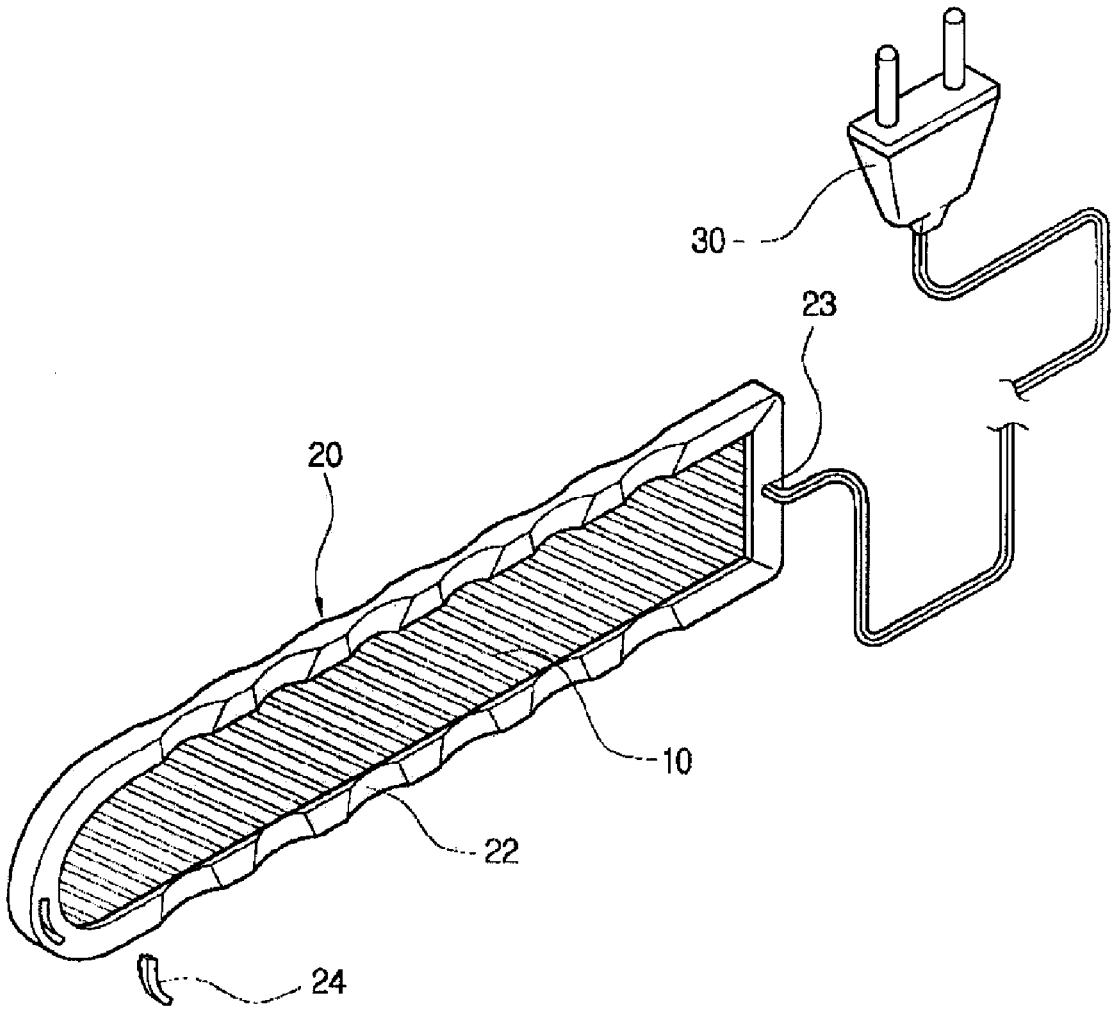
FIG. 2 is a perspective view illustrating a bottom part of a sterilizing apparatus according to one embodiment of the present invention.
Figure 3:
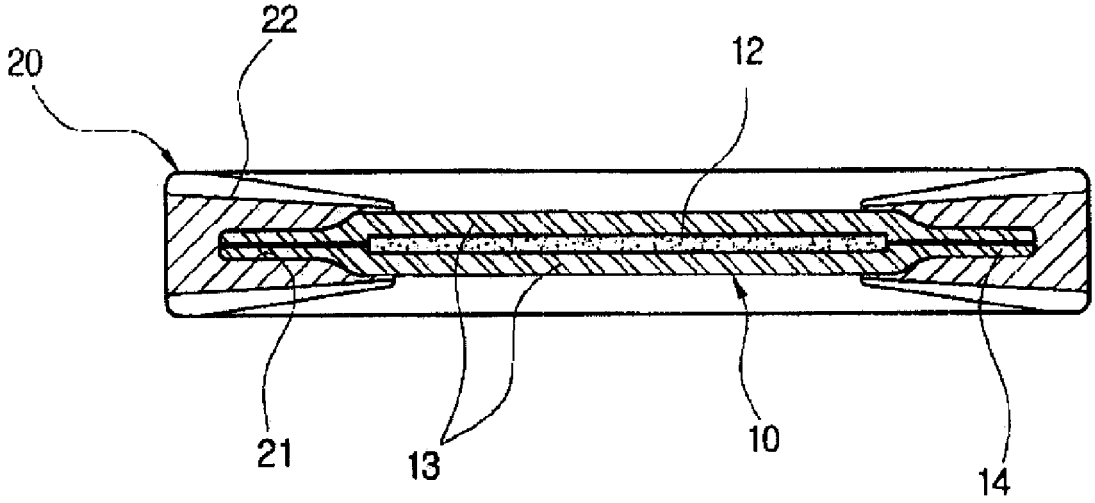
FIGS. 3 and 4 are sectional views taken along lines A-A' and B-B' shown in FIG. 1, respectively.
Figure 4:
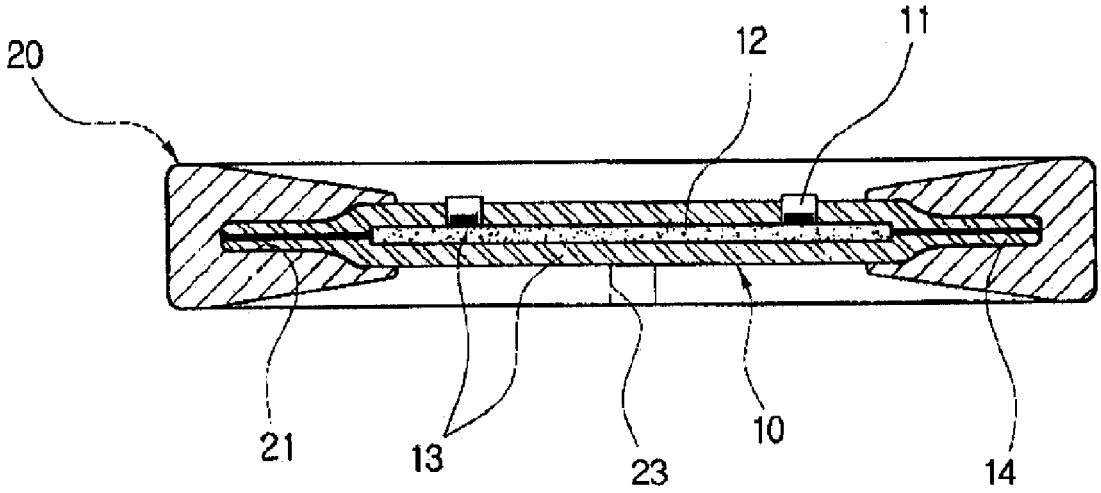

FIG. 1 a partially sectional perspective view illustrating a sterilizing apparatus according to one embodiment of the present invention, FIG. 2 is a perspective view illustrating a bottom part of the sterilizing apparatus according to one embodiment of the present invention, and FIGS. 3 and 4 are sectional views taken along lines A-A' and B-B' shown in FIG. 1, respectively.

The sterilizing apparatus according to the present invention includes a plane heater 10 having a carbon fiber embedded heating paper 12, a pair of electrodes 11 installed at one side of the carbon fiber embedded heating paper 12 while being spaced from each other so as to apply electricity to the carbon fiber embedded heating paper 12, and insulating members 13 stacked on upper and lower portions of the carbon fiber embedded heating paper 12 and edge portions of which are thermally bonded to each other; a housing 20 made of a flexible material and formed at an inner peripheral portion thereof with an insertion groove 21 for receiving the plane heater 10, the housing 20 having a power line receiving hole 23 at a lower end of a bottom surface thereof, a cation generating material receiving hole 24 at an upper end of the bottom surface thereof, and a plurality of corrugated grooves 22 at both lateral sides thereof; an AC/DC converter 30 having a time display section and a timer setting section; and a cation generating material 40 fixedly inserted into the cation generating material receiving hole 24 by means of adhesive.

Carbon fiber can be obtained by heating and carbonizing organic fiber in an inert gas atmosphere. The carbon fiber is made of a raw material, such as cellulose, acryl fiber, vinylon, or pitch. A molecule alignment and crystalline of the carbon fiber may vary depending on the type of the raw materials and the processing temperature thereof. In general, according to the carbon fiber, the hexagonal structure of carbon is continuously formed as a layer lattice structure, so that the carbon fiber represents a metallic brilliance with a black or gray color. The carbon fiber has the strength of 10 to 20 g/d and specific gravity of 1.5 to 2.1 while presenting superior heat-resistant, impact-resistant, chemical-resistant, and insect-resistant characteristics. In addition, the weight of the carbon fiber may be reduced because molecules of the carbon fiber, such as oxygen, hydrogen and nitrogen, are discharged from the carbon fiber during the heating process, so that the carbon fiber is lighter than aluminum and represents the superior elasticity and strength as compared with those of iron.

Due to the above characteristics, the carbon fiber has been extensively used as a high-performance material in the sports industry (a fishing rod, a golf club, and a tennis racket), the aeronautics and space industry, the vehicular industry, the engineering and construction industry, the electric and electronic industry, the communication industry (an antenna), and the environmental industry (an air cleaner and a water purifier).

According to the present invention, the carbon fiber having a diameter of 5 to 50□ and a length of 0.5 to 20 mm is uniformly distributed in a pulp, so that the plane heater 10 can uniformly generate heat over the whole area of the plane heater 10. Therefore, the sterilizing apparatus according to the present invention can solve the problem of the conventional footwear drier, which uses a nichrome wire as a heating wire so that heat is partially generated from the heating wire, thereby causing uneven temperature distribution.

In addition, molecules of the carbon fiber may easily make contact with each other when they are distributed as compared with grain-shaped carbon black powder, so it is possible to vary the content of the carbon fiber in a relatively large range. Thus, it is possible to fabricate the plane heater 10 having various heating characteristics.

The plane heater 10 can be obtained through various processes of fabricating the carbon fiber embedded heating paper 12 by densely distributing the carbon fiber into pulp, installing a pair of electrodes 11 on the carbon fiber embedded heating paper 12 such that the carbon fiber makes contact with the electrodes 11, aligning insulating members 13 (preferably, urethane resin or epoxy resin) on upper and lower portions of the carbon fiber embedded heating paper 12 such that the carbon fiber embedded heating paper 12 and the electrodes are surrounded by the insulating members 13, and thermally bonding outer edge portions of the insulating members 13 such that thermal bonding sections 14 can be formed at the outer edge portions of the insulating members 13. If electric power is applied to the electrodes 11, the carbon fiber is heated so that heat having the high temperature is generated from the carbon fiber. The heat may emit to the exterior through the insulating members 13.

The plane heater 10 fabricated through the above procedure can be bent because the carbon fiber embedded heating paper 12 and the insulating members 13 have flexible characteristics. Thus, the sterilizing apparatus according to the present invention can be easily introduced into the whole area of the bottom of long footwear, such as boots.

In addition, the housing 20 is fabricated in the form of an oblong frame structure, in which the upper portion of the housing 20 is rounded. Thus, the footwear can be easily introduced into the footwear without interfering with an inner portion of the footwear. The housing 20 is formed at the inner peripheral portion thereof with the insertion groove 21 and the plane heater 10 is inserted into the insertion groove 21 and fixed thereto by means of adhesive.

The housing 20 has the power line receiving hole 23 at the lower end of the bottom surface thereof in such a manner that the power line (preferably, a wire) connected to the electrodes 11 can be fixedly inserted into the power line receiving hole 23. In addition, the cation generating material receiving hole 24 is formed at the upper end of the bottom surface of the housing 20 in such a manner that the cation generating material 40 can be inserted into the cation generating material receiving hole 24 and fixed thereto by means of adhesive. The cation generating material 40 can sterilize or kill various bacteria or microorganisms charged anions based on the cation effect, which is generally known in the art, and can absorb micro impurities including dust while removing components causing the bad smell.

Instead of fixedly inserting the cation generating material 40 into the cation generating material receiving hole 24, it is possible to mix the cation generating material 40 with the housing 20 when fabricating the housing 20 in such a manner that the housing 20 can generate the cations. At this time, an amount of the cation generating material 40 mixed with the housing 30 is approximately 3 to 30 weight percent. If the amount of the cation generating material 40 mixed with the housing 30 is less than 3 weight percent, the cation effect may be degraded. In contrast, if the amount of the cation generating material 40 mixed with the housing 30 exceeds 30 weight percent, flexibility of the housing 30 may be lowered.

In addition, a plurality of corrugated grooves 22 can be formed at both lateral sides of the housing 20. Thus, the housing 20 can closely make contact with the inner portion of the footwear, so the footwear can be easily dried by means of heat generated from the plane heater 10.

The sterilizing apparatus according to the present invention uses an AC power for the purpose of stable heat generation. To this end, the sterilizing apparatus employs the AC/DC converter 30 having the time display section (not shown) and the timer setting section (not shown). Accordingly, the heating operation of the sterilizing apparatus can be stopped after the footwear has been dried, thereby preventing a disaster, such as a fire, while preventing the quality and endurance of the footwear from being degraded.

The housing 20 is preferably made of flexible synthetic resin. However, the present invention does not limit the materials for the housing 20, so long as they cannot be deformed caused by heat generated from the plane heater 10. In addition, the present invention does not limit the type of the cation generating material 40, so long as the cation generating material 40 can generate a great amount of cations. For instance, the cation generating material 40 may include metal powder charged with the cation, such as Ca, Na or Mg. The metal powder is input into a wrapping vessel made from a non-fabric material and is inserted into the cation generating material receiving hole 24. If the heat is generated from the plane heater 10, the cation generating material 40 generates a great amount of metallic cations.

When using the sterilizing apparatus having the above structure, the user inserts the sterilizing apparatus into the footwear, and then sets a drying time for the footwear by using the timer setting section (not shown). In this state, the AC power is applied to the sterilizing apparatus. That is, the AC power is applied to the carbon fiber embedded heating paper 12 through the electrodes 11 of the plane heater 10, thereby generating heat. The heat may emit toward the inner portion of the footwear through the corrugated grooves 22 formed at both lateral sides of the housing 20, thereby drying the inner portion of the footwear.

In particular, since the sterilizing apparatus for the footwear according to the present invention is designed adaptable for the AC power, it is possible to dry the footwear even in a place having no electricity by using a battery, so safety of the sterilizing apparatus can be improved. In addition, the sterilizing apparatus can be fabricated in a compact size, so that the user can easily carry the sterilizing apparatus. Furthermore, since the sterilizing apparatus is made of a flexible material, the sterilizing apparatus can be introduced into the whole area of the bottom of long footwear, such as boots. In addition, since the most of harmful bacteria living in the footwear may be charged with the anions, the harmful bacteria living in the footwear may react with the cations generated from the cation generating material 40, so that the harmful bacteria are sterilized or killed.

As described, the present invention provides a sterilizing apparatus for footwear, in which the sterilizing apparatus includes a plane heater having a carbon fiber embedded heating paper, a pair of electrodes installed at one side of the carbon fiber embedded heating paper while being spaced from each other so as to apply electricity to the carbon fiber embedded heating paper, and insulating members stacked on upper and lower portions of the carbon fiber embedded heating paper and edge portions of which are thermally bonded to each other; a housing made of a flexible material and formed at an inner peripheral portion thereof with an insertion groove for receiving the plane heater, in which the housing has a power line receiving hole at a lower end of a bottom surface thereof, a cation generating material receiving hole at an upper end of the bottom surface thereof, and a plurality of corrugated grooves at both lateral sides thereof; an AC/DC converter having a time display section and a timer setting section; and a cation generating material fixedly inserted into the cation generating material receiving hole by means of adhesive, wherein the harmful bacteria charged with the anions can be sterilized or killed by means of the cation generating material, the footwear can be dried by means of heat generated from the plane heater, the sterilizing apparatus can be easily introduced into the whole area of the bottom of long footwear, such as boots, because the plane heater and the housing have the flexible characteristics, and stability of the sterilizing apparatus can be improved because the sterilizing apparatus uses AC power with the timer.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sterilizing apparatus for footwear, the sterilizing apparatus comprising:

a plane heater including a carbon fiber embedded heating paper, a pair of electrodes installed at one side of the carbon fiber embedded heating paper while being spaced from each other so as to apply electricity to the carbon fiber embedded heating paper, and insulating members stacked on upper and lower portions of the carbon fiber embedded heating paper and edge portions of which are thermally bonded to each other;

a housing made of a flexible material and formed at an inner peripheral portion thereof with an insertion groove for receiving the plane heater, the housing having a power line receiving hole at a lower end of a bottom surface thereof, a cation generating material receiving hole at an upper end of the bottom surface thereof, and a plurality of corrugated grooves at both lateral sides thereof;

an AC/DC converter having a time display section and a timer setting section; and a cation generating material fixedly inserted into the cation generating material receiving hole by means of adhesive.

2. The sterilizing apparatus as claimed in claim 1, wherein the cation generating material is mixed with the housing when the housing is fabricated without inserting the cation generating material into the cation generating material receiving hole.

3. The sterilizing apparatus as claimed in claim 2, wherein an amount of the cation generating material mixed with the housing is approximately 3 to 30 weight percent.

* * * * *